US005735602A

United States Patent [19]

Salvatore

[11] Patent Number: 5,735,602

[45] Date of Patent: Apr. 7, 1998

[54] MACHINE FOR PRODUCING SLUSH, GRANITA AND OTHER SIMILAR PRODUCTS

[75] Inventor: Cortese Salvatore, Casandrino, Italy

[73] Assignee: Elmeco S.R.L., Naples, Italy

[21] Appl. No.: 582,306

[22] Filed: Jan. 3, 1996

[30] Foreign Application Priority Data

Aug. 2, 1995 [IT] Italy ..... NA95A0038

[51] Int. Cl.[6] ..... B01F 7/02

[52] U.S. Cl. ..... 366/314; 366/331

[58] Field of Search ..... 366/96–100, 314, 366/318, 331, 349; 99/348

[56] References Cited

U.S. PATENT DOCUMENTS

| | | | |
|---|---|---|---|
| 6,961 | 12/1849 | Stanton | 366/331 X |
| 1,166,568 | 1/1916 | Wilton | 366/314 |
| 1,219,491 | 3/1917 | Santicola | 366/331 |
| 1,468,826 | 9/1923 | Minney | 366/314 |
| 1,486,334 | 3/1924 | Hapgood | 366/314 X |
| 1,718,613 | 6/1929 | Treffinger | 366/314 X |
| 1,834,936 | 12/1931 | Bryant | 366/314 X |
| 1,930,948 | 10/1933 | Brewer | 366/314 |
| 2,005,950 | 6/1935 | Moroney et al. | 366/331 X |
| 2,351,361 | 6/1944 | Ockrant et al. | 366/331 X |
| 2,774,576 | 12/1956 | Frank, Sr. | 366/314 |
| 2,788,643 | 4/1957 | Martin | 366/318 X |
| 3,036,820 | 5/1962 | Berwick et al. | 366/314 X |
| 4,583,863 | 4/1986 | Pandolfi | 366/314 X |
| 4,900,158 | 2/1990 | Ugolini | 366/331 X |

FOREIGN PATENT DOCUMENTS

| | | | |
|---|---|---|---|
| 2416406 | 10/1979 | France | 366/314 |

*Primary Examiner*—Charles E. Cooley
*Attorney, Agent, or Firm*—Michael J. Striker

[57] ABSTRACT

A machine for producing slush, granita and similar products has a bowl, a stirring implement operative for stirring liquid contained in the bowl, a drive shaft extending through the bowl and connected with the stirring implement, drive element connected with the drive shaft and operative for rotating the drive shaft so as to rotate the stirring implement, a first substantially cylindrical element surrounding the drive shaft and having an upper edge exceeding a maximum filling level of the bowl, another substantially cylindrical element externally surrounding the first mentioned substantially cylindrical element and extending inside the bowl starting from a top of the bowl so as to reach the stirring implement, and an element for connecting the other substantially cylindrical element with the drive shaft.

3 Claims, 4 Drawing Sheets

MACHINE FOR PRODUCING SLUSH, GRANITA AND OTHER SIMILAR PRODUCTS

BACKGROUND OF THE INVENTION

The present invention relates to a machine for producing slush, granita and other similar products.

Machines of the above mentioned general type are known in the art. A known machine for production of slush or granita has a refrigerated bowl in which a liquid to be treated is stirred to prevent freezing, so as to keep the resulting-.product in a slush consistency. The stirring action is obtained using blades, propellers or other implements for stirring or scraping mechanically. The implement is connected to a revolving shaft which is moved by an electric motor located outside of the bowl. The disadvantage of the inventive machine is that the rotating shaft which goes through the bowl requires a gasket. The gasket on the one hand must allow the shaft to rotate, and on the other hand, it must be water tight so as not to allow the liquid in the bowl to reach the motor. During the operation the gaskets often wear out and have to be replaced, which requires additional time for up-keeping.

SUMMARY OF THE INVENTION

Accordingly, it is an object of the present invention to provide a machine for producing slush, granita and the like, which avoids the disadvantages of the prior art.

In keeping with these objects and with others which will become apparent hereinafter, one feature of the present invention resides, briefly stated, in a machine for producing slush, granita and the like, in which a transmission of the movement of the stirring shaft is formed so that it does not require any gasket between the bowl and the motor compartment.

In particular, in accordance with the present invention a drive shaft is enclosed in a cylindrical surface with an upper edge exceeding a maximum filling level of the bowl and externally surrounded by another hollow cylinder which reaches a stirring implement inside the bowl, starting from the top of the bowl, and a key connects the last mentioned cylinder to the drive shaft.

When the machine is designed in accordance with the present invention, no gasket is required between the rotating shaft and the bowl.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 4 is a perspective external view of the inventive machine for production of slush, granita and the like.

DESCRIPTION OF THE PREFERRED EMBODIMENTS

Figure 1:
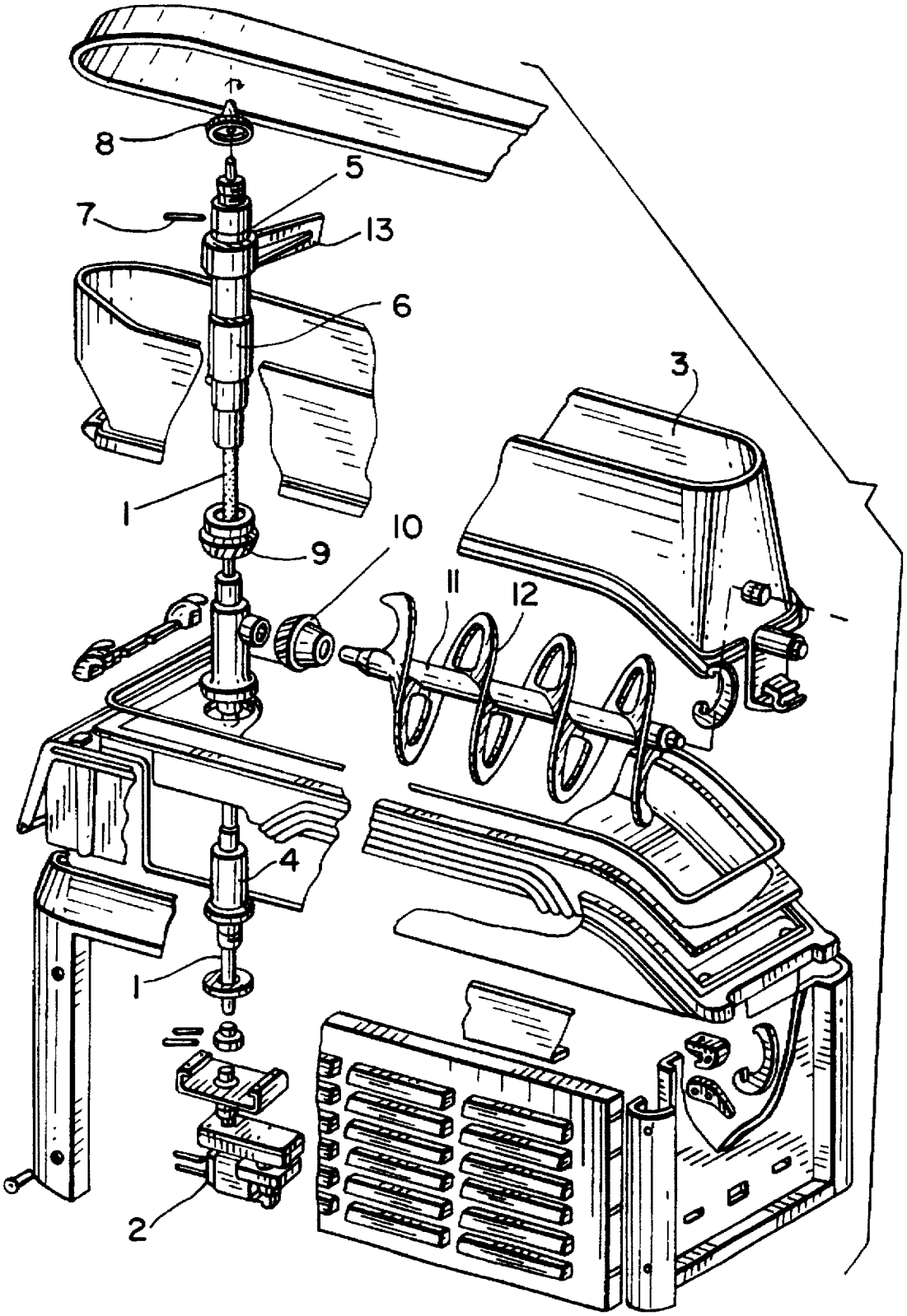
FIG. 1 is an exploded view of a machine for producing slush, granita and the like in accordance with the present invention.

A machine for production of slush, granita and the like has a drive shaft 1 which is driven by an electric motor 2 and forms also a transmission shaft. The drive shaft 1 extends vertically higher than a bowl 3. A hollow cylinder 4 coaxially surrounds the drive shaft 1 and extends vertically to a point which is higher than the bowl 3 and lower than the uppermost point of the drive shaft 1. In any case the cylinder 4 extends to the point which is higher than the maximum liquid level 5 in the bowl 3.

A second hollow cylinder 6 which coaxially surrounds the hollow cylinder 4 is closed by a top 8. The second cylinder 6 extends from a top of the drive shaft 1 and is connected with the shaft 1 through a key 7. A pinion 9 which is a part of the cylinder 6, is provided substantially in a middle point of the shaft 1 and engages with a gear wheel 10. The gear wheel 10 is mounted on an end of a horizontal shaft 11 of a stirring and scraping blade 12. Another stirring blade 13 can be also connected to the second hollow cylinder 6 if necessary.

Figure 2:
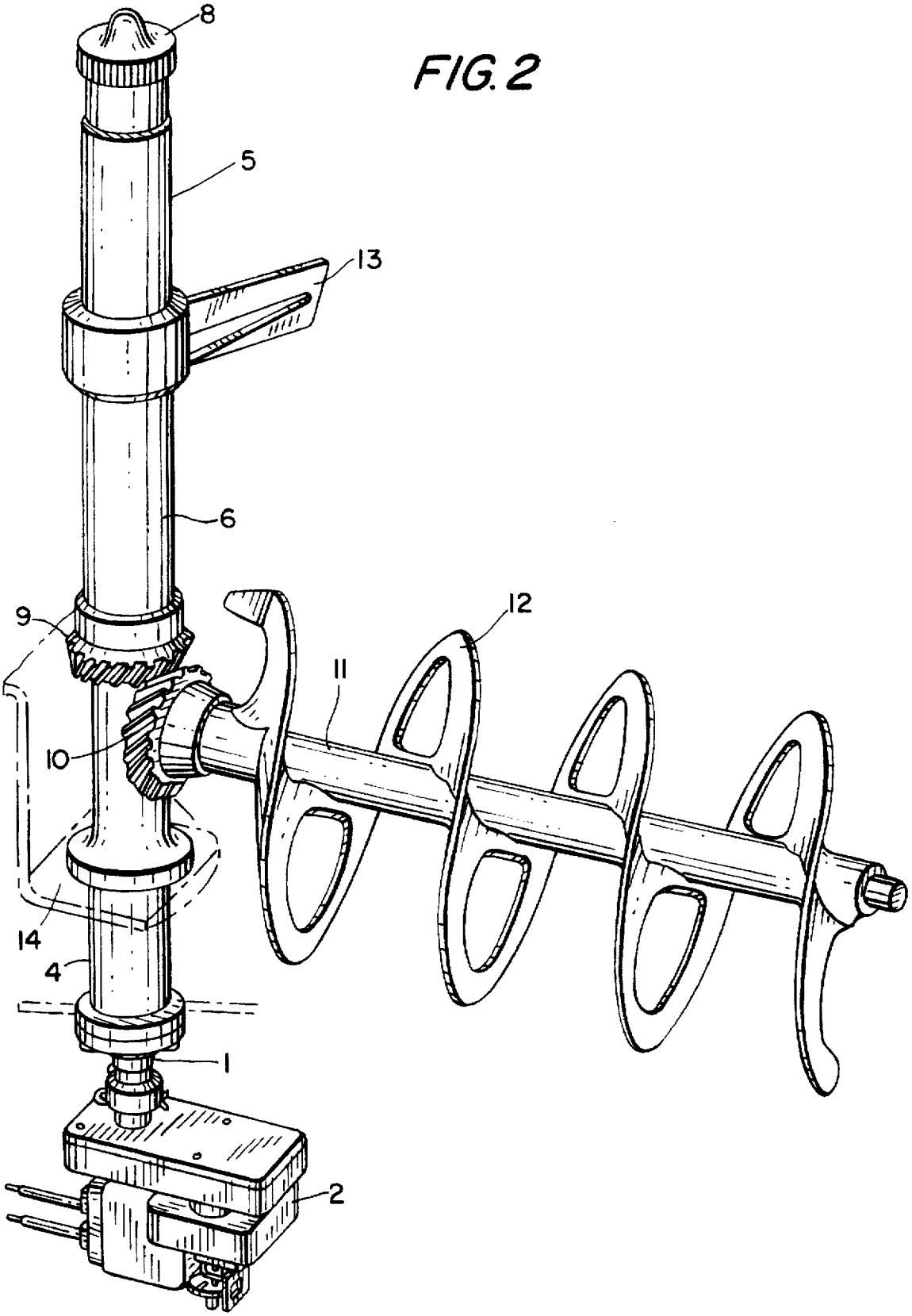
FIG. 2 is a perspective view of a transmission of the inventive machine in accordance with the present invention.
Figure 3:
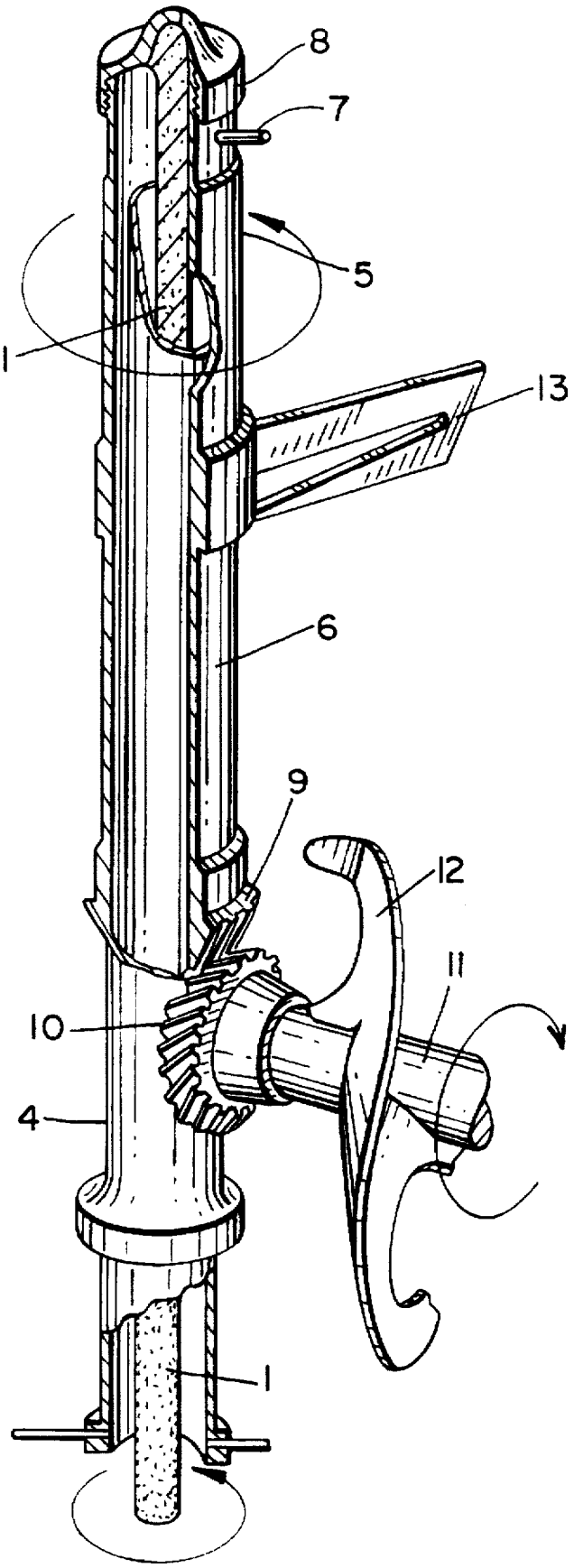
FIG. 3 is a view showing a section of the transmission of the inventive machine of the present invention.
Figure 4:
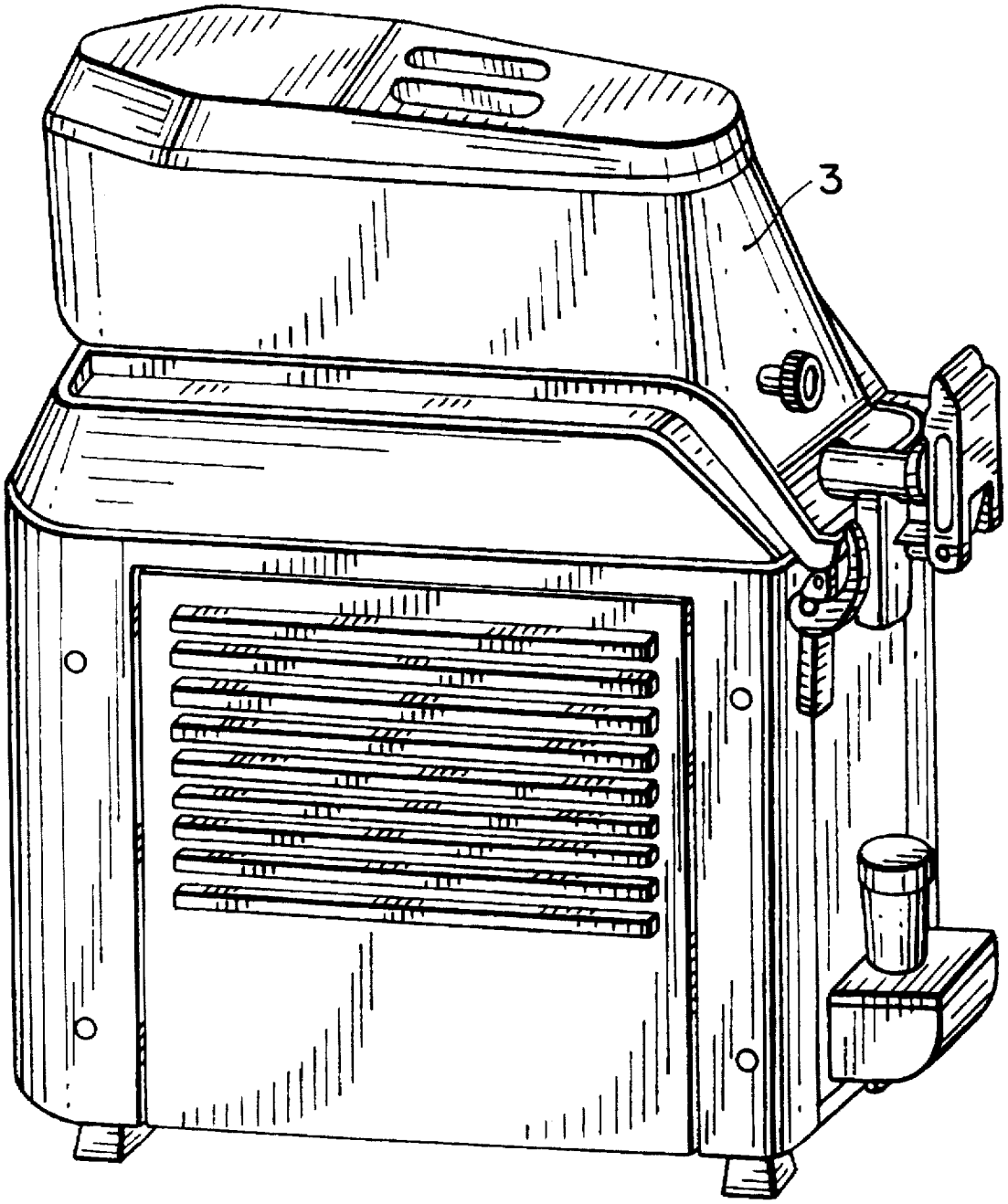

During the operation of the machine, the movement is transmitted from the electric motor 2 to the stirring and scraping blade 12 by the hollow cylinder 6 which in fact is formed as a hollow rotating shaft and connected to the main shaft 1. As a result, there is no connection or interaction between the bowl 3 and the rotating shaft 1. Therefore, no gasket 14 is needed between the bowl and the rotating shaft (a conventional gasket is shown in broken lines in FIG. 2), and there is no longer a problem with wearing out of a gasket because of the friction. Also, the liquid accommodated in the bowl cannot leak into the electric motor, which frequently caused breakdowns of conventional machines. The electric motor can be placed under the bowl in a position which is more convenient for the construction and operation of the machine.

It will be understood that each of the elements described above, or two or more together, may also find a useful application in other types of constructions differing from the types described above.

While the invention has been illustrated and described as embodied in a machine for producing slush, granita and other similar products, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A machine for producing slush, granita and similar products, comprising a substantially horizontal bowl; a stirring implement located in said bowl and rotating in said bowl about a substantially horizontal axis; a drive shaft extending substantially vertically through said bowl; a substantially cylindrical element surrounding said drive shaft and fixedly connected with said drive shaft for joint rotation with said shaft; said cylindrical element being connected with said stirring implement so as to connect said drive shaft with said stirring implement; drive means connected with a lower end of said drive shaft and rotating said drive shaft and said cylindrical element so as to rotate said stirring implement.

2. A machine for producing slush, granita and similar products, comprising a bowl; a stirring element located in said bowl and rotating in said bowl about a substantially horizontal axis; a drive shaft extending substantially vertically through said bowl; a substantially cylindrical element surrounding said drive shaft and fixedly connected with said drive shaft for joint rotation with said shaft; drive means connected with one end of said drive shaft and rotating said drive shaft and said cylindrical element so as to rotate said stirring implement; and means for transmitting a rotation of said drive shaft to said stirring element; said transmitting means including a pinion arranged on said cylindrical element and a gear wheel mounted on said stirring implement and engaging with said pinion; said pinion and said gear wheel being located in said bowl.

3. A machine for producing slush, granita and similar products, comprising a bowl; a stirring implement located in said bowl and rotating in said bowl about a substantially horizontal axis; a drive shaft extending substantially vertically through said bowl; a substantially cylindrical element surrounding said drive shaft and fixedly connected with said drive shaft for joint rotation with said shaft; drive means connected with one end of said drive shaft and rotating said drive shaft and said cylindrical element so as to rotate said stirring implement; and another stirring implement located in said bowl and connected with said cylindrical element so as to rotate about a substantially vertical axis.

* * * * *